US009523951B2

(12) United States Patent
Suzuki et al.

(10) Patent No.: US 9,523,951 B2
(45) Date of Patent: Dec. 20, 2016

(54) FIXING APPARATUS FOR FIXING TONER IMAGE ON A RECORDING MEDIUM OF TUBULAR SHAPE

(71) Applicant: CANON KABUSHIKI KAISHA, Tokyo (JP)

(72) Inventors: Junji Suzuki, Hiratsuka (JP); Tsuyoshi Yamaguchi, Ichikawa (JP); Nozomu Nakajima, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/962,057

(22) Filed: Dec. 8, 2015

(65) Prior Publication Data

US 2016/0170351 A1 Jun. 16, 2016

(30) Foreign Application Priority Data

Dec. 10, 2014 (JP) ..... 2014-250404

(51) Int. Cl.
*G03G 15/20* (2006.01)
*G03G 15/00* (2006.01)

(52) U.S. Cl.
CPC ..... *G03G 15/2082* (2013.01); *G03G 15/2064* (2013.01); *G03G 15/80* (2013.01); *G03G 2215/2035* (2013.01)

(58) Field of Classification Search
CPC ..... G03G 15/2014; G03G 15/2042; G03G 15/2053; G03G 15/2082; G03G 15/80; G03G 15/2064; G03G 2215/2035
USPC ..... 399/328, 329, 330, 333; 219/216
See application file for complete search history.

(56) References Cited

U.S. PATENT DOCUMENTS

| | | | | |
|---|---|---|---|---|
| 8,417,170 B2 * | 4/2013 | Kimura | G03G 15/2064 | 399/329 |
| 2014/0186078 A1 * | 7/2014 | Imaizumi | G03G 15/2053 | 399/329 |
| 2015/0023704 A1 * | 1/2015 | Imaizumi | G03G 15/2053 | 399/329 |
| 2015/0139706 A1 * | 5/2015 | Fujiwara | G03G 15/2064 | 399/329 |
| 2015/0139708 A1 * | 5/2015 | Shimura | G03G 15/2042 | 399/329 |

FOREIGN PATENT DOCUMENTS

| | | | |
|---|---|---|---|
| JP | H1184919 A | | 3/1999 |
| JP | H11190951 A | | 7/1999 |
| JP | 2003257592 A | * | 9/2003 |
| JP | 2014130241 A | | 7/2014 |

* cited by examiner

*Primary Examiner* — Sophia S Chen
(74) *Attorney, Agent, or Firm* — Canon U.S.A. Inc., IP Division

(57) ABSTRACT

A fixing apparatus having a tubular shape, a heater, a heat conduction member that contacts a surface of the heater, a support member configured to support the heater via the heat conduction member, a roller that forms a nip portion with the heater via the film, and a connector arranged in any one of end portions of the heater, wherein the heat conduction member includes a restriction portion configured to restrict a movement of the heat conduction member, and wherein the restriction portion is arranged only in a region that is closer to the connector than a position, of the nip portion, to which the maximum pressure is applied.

12 Claims, 12 Drawing Sheets

WHEN PRESSURE IS APPLIED

WHEN PRESSURE IS RELESED

LONGITUDINAL SECTIONAL VIEW

TRANSVERSE SECTIONAL VIEW
OF POWER SUPPLY CONNECTOR

TRANSVERSE SECTIONAL
VIEW OF HEATER CLIP

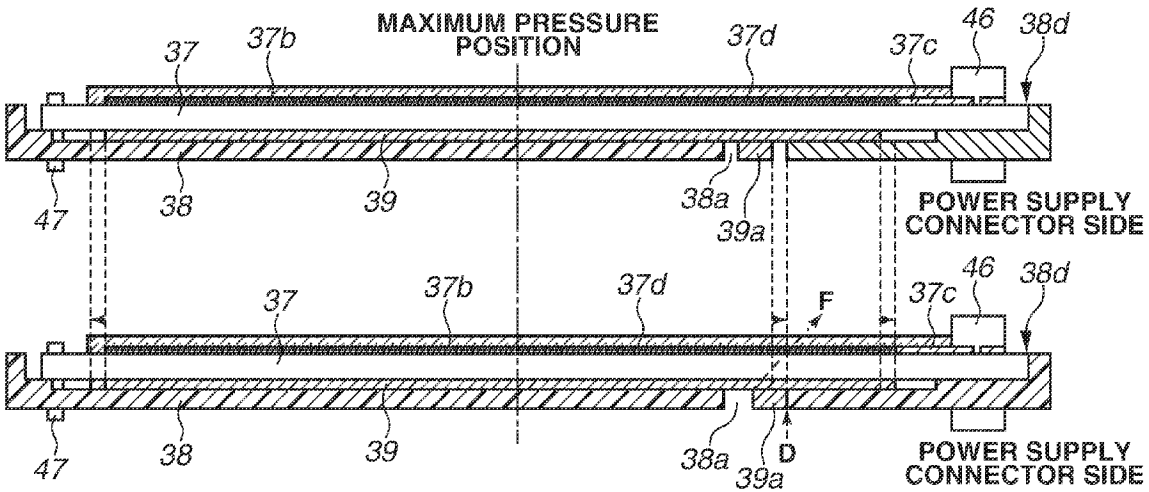
FIG.8A
WHEN HEATER IS AT NORMAL TEMPERATURE
FIG.8B
WHEN HEATER GENERATE HEAT
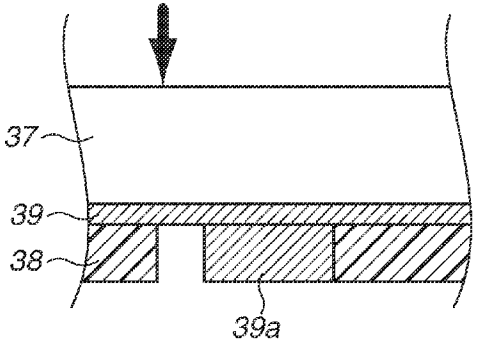
FIG.8C
ENLARGED VIEW OF AREA D (BEFORE DEFORMATION OF HEAT CONDUCTION MEMBER)
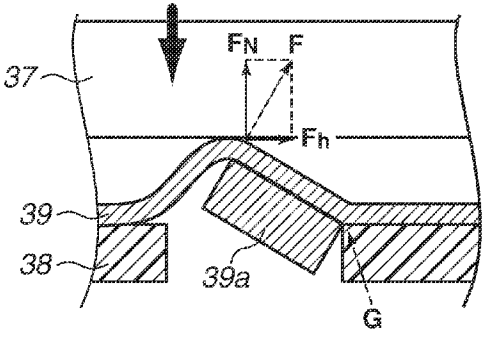
FIG.8D
ENLARGED VIEW OF AREA D (AFTER DEFORMATION OF HEAT CONDUCTION MEMBER)

WHEN HEATER IS AT NORMAL TEMPERATURE

WHEN HEATER GENERATES HEAT (FIRST EXEMPLARY EMBODIMENT)

WHEN HEATER GENERATES HEAT (SECOND EXEMPLARY EMBODIMENT)

WHEN HEATER IS AT NORMAL TEMPERATURE

WHEN HEATER GENERATE HEAT

FIXING APPARATUS FOR FIXING TONER IMAGE ON A RECORDING MEDIUM OF TUBULAR SHAPE

BACKGROUND OF THE INVENTION

Field of the Invention

The present invention relates to a fixing apparatus used in an image forming apparatus, for example, a copier and a laser beam printer (LBP) employing an image forming process, such as an electrophotographic method and an electrostatic recording method.

Description of the Related Art

A fixing apparatus with a film having a tubular shape is known as a fixing apparatus which is disposed in an electrophotographic image forming apparatus. Such a fixing apparatus includes a film having a tubular shape, a heater that contacts an inner surface of the film, and a pressing member that forms a nip portion with the heater via the film. Generally, in the nip portion, the fixing apparatus applies heat to a toner image while conveying a recording medium bearing the toner image.

As for such a fixing apparatus with the film having a small heat capacity, temperature of a region in which a recording medium does not pass tends to excessively rise although warm-up time is short. That is, a sheet non-passing area temperature rise is liable to occur. Japanese Patent Application Laid-Open No. 11-84919 discusses a configuration in which a heat conduction member is arranged between a heater and a heater support member. Such a configuration facilitates movement of heat inside a surface of the heater so that a temperature distribution of the heater in a longitudinal direction becomes uniform.

However, in a fixing apparatus including a heat conduction member that contacts a heater as discussed in Japanese Patent Application Laid-Open No. 11-84919, the heater may move in a longitudinal direction due to longitudinal thermal expansion of the heat conduction member. In such a case, the heater is displaced from a reference position. The displacement of the heater causes displacement of a heating region of a recording medium by a film. This may deteriorate fixability of a toner image.

SUMMARY OF THE INVENTION

According to an aspect of the present invention, a fixing apparatus that fixes a toner image on a recording medium includes a film having a tubular shape, a heater having a long narrow shape and contacting an inner surface of the film, a heat conduction member that contacts, along a longitudinal direction of the heater, a surface on an opposite side of a surface of the heater contacting the film, a support member configured to support the heater via the heat conduction member, a roller that forms a nip portion with the heater via the film, and a connector arranged in any one of end portions of the heater in the longitudinal direction and configured to supply electric power to the heater, wherein the heat conduction member includes a restriction portion configured to restrict a movement of the heat conduction member in the longitudinal direction of the heater with respect to the support member, and wherein the restriction portion is arranged only in a region, of the heat conduction member, that is closer to the connector than a position, of the nip portion, to which the maximum pressure is applied in the longitudinal direction.

According to another aspect of the present invention, a fixing apparatus that fixes a toner image on a recording medium includes a film having a tubular shape, a heater having a long narrow shape and contacting an inner surface of the film, a heat conduction member that contact, along a longitudinal direction of the heater, a surface on an opposite side of a surface of the heater contacting the film, a support member configured to support the heater via the heat conduction member, the support member including a positioning portion configured to determine a position of the heater in the longitudinal direction by contacting an end portion of the heater in the longitudinal direction; and a roller that forms a nip portion with the heater via the film, wherein the heat conduction member includes a restriction portion configured to restrict a movement of the heat conduction member in the longitudinal direction of the heater with respect to the support member, and wherein the restriction portion is arranged only in a region, of the heat conduction member, that is closer to the positioning portion than a position, of the nip portion, to which the maximum pressure is applied in the longitudinal direction.

Further features of the present invention will become apparent from the following description of exemplary embodiments with reference to the attached drawings.

BRIEF DESCRIPTION OF THE DRAWINGS

FIG. 8A is a diagram illustrating a state of the heat conduction member when the heater is at normal temperature according to the first exemplary embodiment, FIG. 8B is a diagram illustrating a state of the heat conduction member when the heater generates heat according to the first exemplary embodiment, FIG. 8C is an enlarged view illustrating the restriction portion of the heat conduction member before modification when the heater generates heat according to the first exemplary embodiment, and FIG. 8D is an enlarged view illustrating the restriction portion of the heat conduction member after modification when the heater generates heat according to the first exemplary embodiment.

DESCRIPTION OF THE EMBODIMENTS

Hereinafter, exemplary embodiments of the present invention are described in detail with reference to the drawings.

In the below description of apparatus configurations, the term "longitudinal direction" represents a direction perpendicular to a conveyance direction of a recording medium, whereas the term "transverse direction" represents a direction parallel to the conveyance direction of the recording medium.

Figure 1:
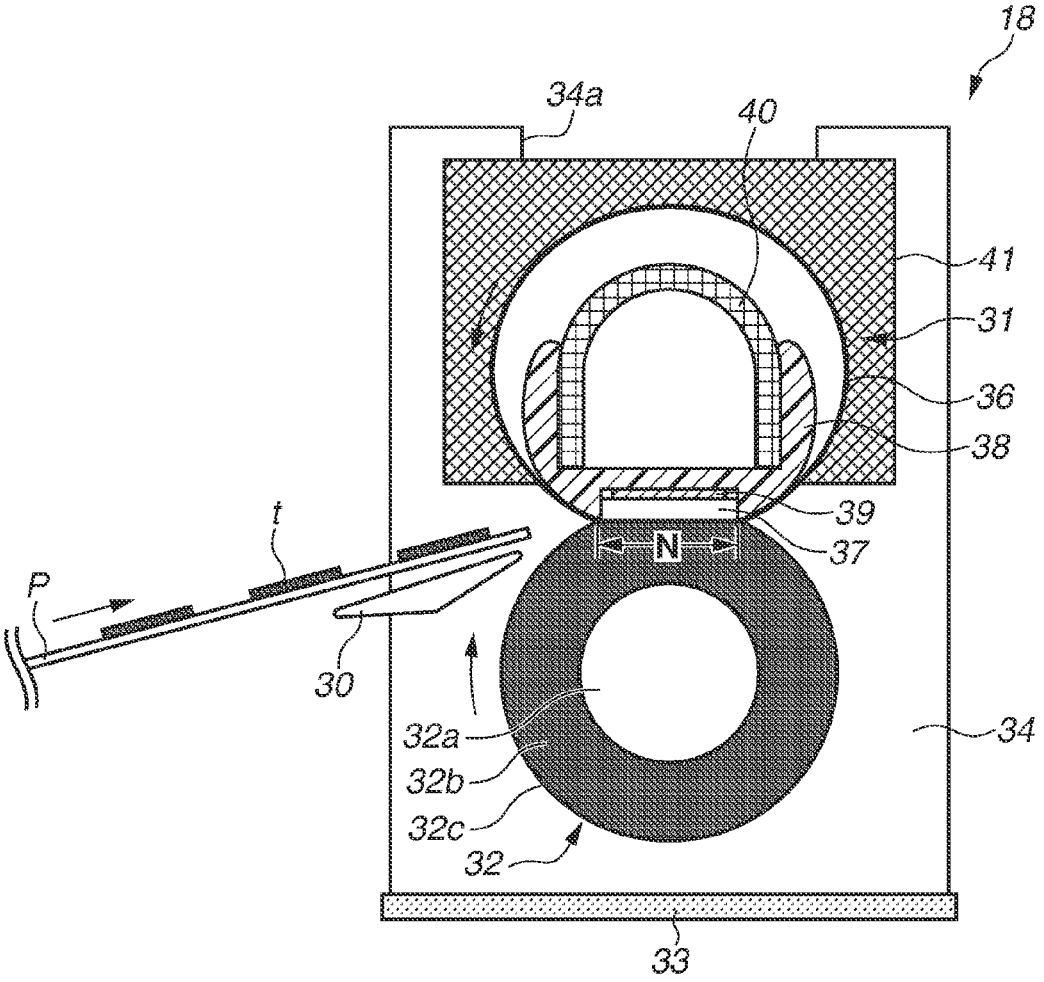
FIG. 1 is a schematic sectional view illustrating a configuration of a fixing apparatus according to a first exemplary embodiment of the present invention.
Figure 2A:
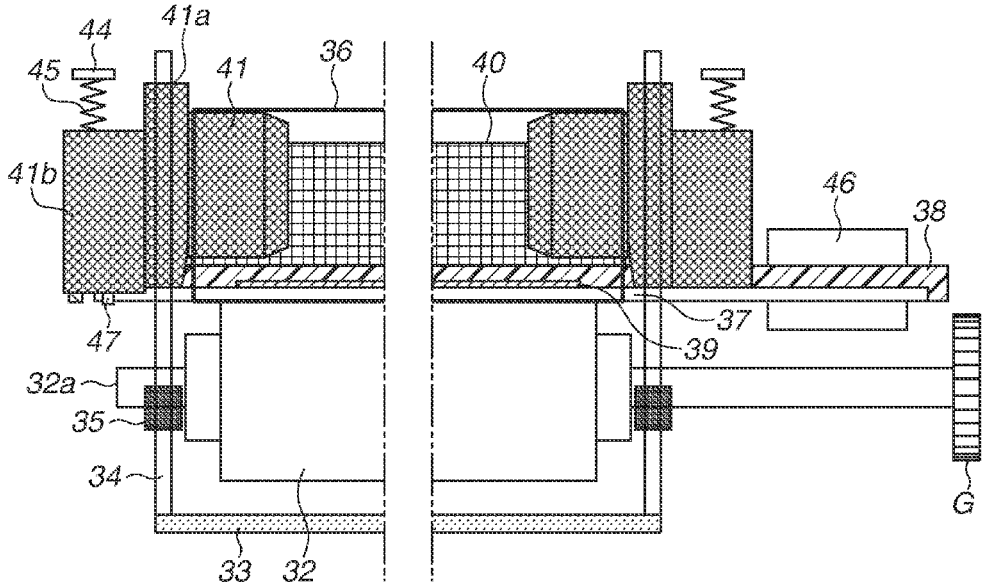
FIG. 2A is a schematic front view illustrating the configuration of the fixing apparatus according to the first exemplary embodiment when pressure is applied.
Figure 2B:
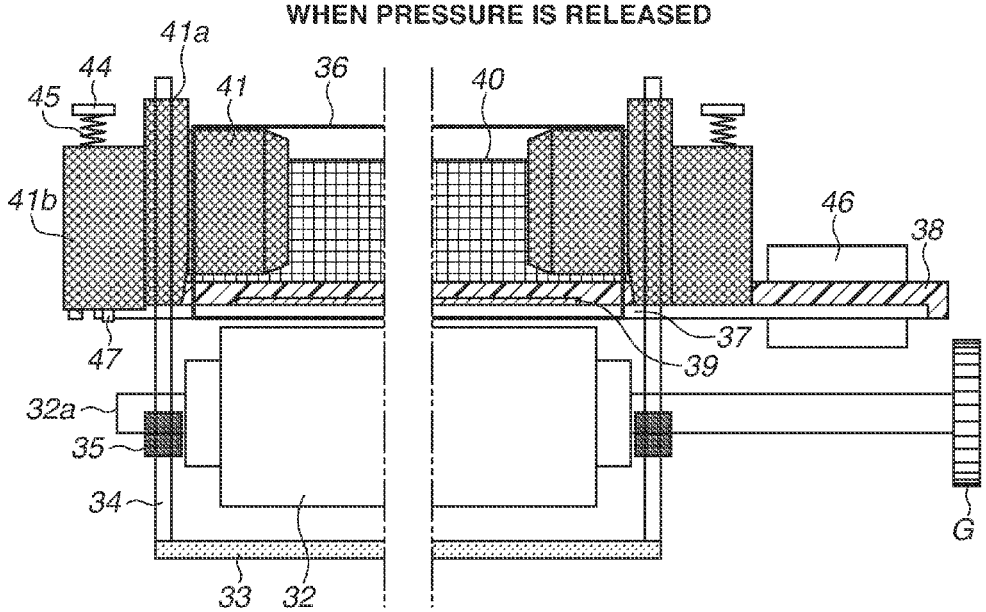
FIG. 2B is a schematic front view illustrating the configuration of the fixing apparatus according to the first exemplary embodiment when pressure is released.

FIG. 1 is a schematic sectional view illustrating a configuration of a fixing apparatus 18, as seen from a longitudinal direction, according to a first exemplary embodiment of the present invention. FIGS. 2A and 2B are schematic diagrams illustrating an end portion of the fixing apparatus 18, as seen from a transverse direction.

The fixing apparatus 18 includes a film unit 31 including a film 36 having a tubular shape, and a pressing roller 32 serving as a pressing member. The film unit 31 and the pressing roller 32 are arranged substantially parallel to each other between right and left side plates 34 of an apparatus frame 33 in a direction in which a heater 37 is arranged opposite to the pressing roller 32 via the film 36.

The pressing roller 32 includes a metal core 32*a*, an elastic layer 32*b*, and a release layer 32*c*. The elastic layer 32*b* is formed on the outer side of the metal core 32*a*, and the release layer 32*c* is formed on the outer side the elastic layer 32*b*. The elastic layer 32*b* is made of a material, such as silicone rubber, fluoro rubber or the like. The release layer 32*c* is made of a material, such as perfluoroalkoxy (PFA), polytetrafluoroethylene (PTFE), fluorinated ethylene propylene (FEP), or the like.

The pressing roller 32 used in the present exemplary embodiment is as follows. On the stainless steel metal core 32*a* having an outer diameter of 11 mm, the silicone rubber elastic layer 32*b* having a thickness of approximately 3.5 mm is formed by injection molding. The outer side of the elastic layer 32*b* is covered with the PFA resin tube, serving as the release layer 32*c*, having a thickness of approximately 40 μm. The pressing roller 32 has an outer diameter of 18 mm. From a standpoint of maintenance and durability of a nip portion N, the pressing roller 32 desirably has a hardness in a range between 40° and 70° where a weight is 9.8 N by an ASKER-C durometer. In the present exemplary embodiment, a hardness of the pressing roller 32 is adjusted to 54°. The elastic layer 32*b* of the pressing roller 32 has a longitudinal length of 226 mm. As illustrated in FIGS. 2A and 2B, at both end portions of the metal core 32*a* in the longitudinal direction, the pressing roller 32 is rotatably supported between the side plates 34 via bearing members 35. A drive gear G is fixed to one end of the metal core 32*a*. When a drive source (not illustrated) transmits a rotary force to the drive gear G, the pressing roller 32 is rotationally driven.

The film unit 31 illustrated in FIG. 1 include the film 36, a long narrow plate-like heater 37 that contacts an inner surface of the film 36, a support member for supporting the heater 37, and a heat conduction member 39. The film unit 31 further includes a pressing stay 40 and a flange 41. The pressing stay 40 reinforces the support member 38, and the flange 41 restricts a longitudinal movement of the film 36.

The film 36, serving as a member having a tubular shape and flexibility, includes a base layer, an elastic layer formed on an outer side of the base layer, and a release layer formed on an outer side of the elastic layer. The film 36 used in the present exemplary embodiment is as follows. The film 36 has an inner diameter of 18 mm. A polyimide base having a thickness of 60 μm is used as the base layer. Silicone rubber having a thickness of approximately 150 μm is used as the elastic layer, and PFA resin tube having a thickness of approximately 15 μm is used as the release layer. As illustrated in FIG. 1, the support member 38 has a substantially semicircular gutter-like cross section. The support member 38 has rigidity, heat resistance, and thermal insulation. In the present exemplary embodiment, the support member 38 is made of liquid crystal polymer. The support member 38 has a function for supporting the inner surface of the film 36 which is fitted outside the support member 38, and a function for supporting one surface of the heater 37.

Figure 3:
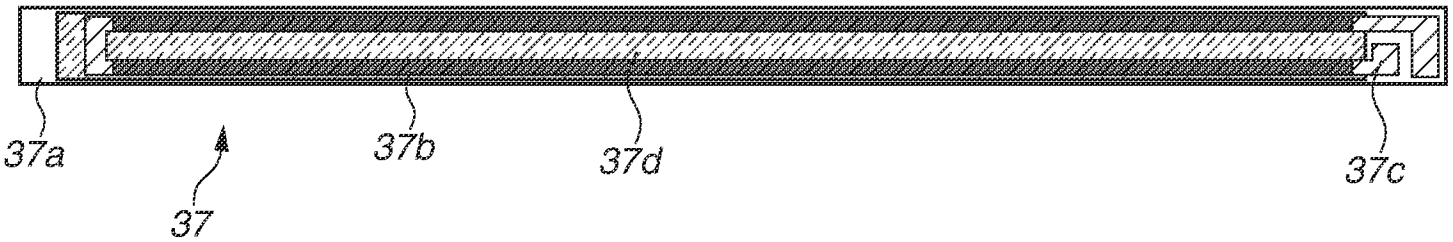
FIG. 3 is a diagram illustrating a heater according to the first exemplary embodiment.

As illustrated in FIG. 3, the heater 37 includes a substrate 37*a* made of ceramics, such as alumina, aluminum nitride or the like, a heat generating resistor 37*b* made of silver-palladium alloy or the like, and an electric contact portion (electrode) 37*c* made of silver or the like, for example. The heat generating resistor 37*b* is formed on the substrate 37*a* by processing such as screen printing, and the electric contact portion 37*c* is connected to the heat generating resistor 37*b*. In the present exemplary embodiment, two heat generating resistors 37*b* are connected in series, and have a resistance value of 18Ω. A glass coat 37*d* as a protective layer is formed on the heat generating resistor 37*b* to protect the heat generating resistor 37*b* and enhance slidability with respect to the film 36. The heater 37 is arranged along the longitudinal direction of the film 36 in a state where the heater 37 opposes a support surface of the support member 38. In the present exemplary embodiment, the substrate 37*a* of the heater 37 has a rectangular solid shape having a longitudinal length of 270 mm, a transverse length of 5.8 mm, and a thickness of 1.0 mm. The substrate 37*a* is made of alumina. A length in the longitudinal direction of the heat generating resistor 37*b* is 222 mm. The inner surface of the film 36 is coated with heat resistant grease, thereby enhancing slidability of the heater 37 and the support member 38 with respect to the inner surface of the film 36.

Figure 4:
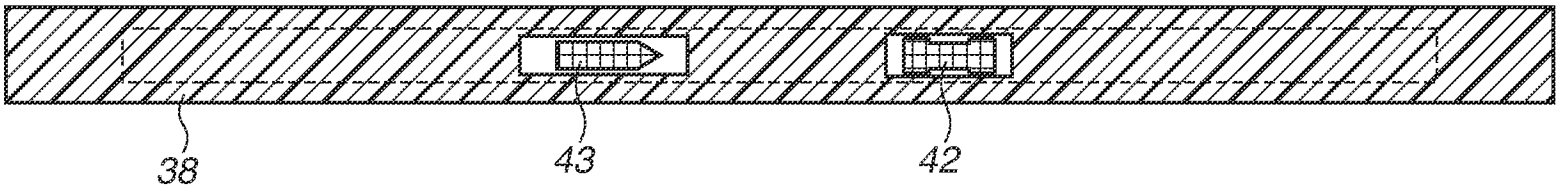
FIG. 4 is a diagram illustrating a thermistor and a thermal fuse according to the first exemplary embodiment.

FIG. 4 is a diagram illustrating the support member 38, a thermistor 42 serving as a temperature-sensitive element, and a thermal fuse 43 serving as a safety element. The support member 38 has through holes. The thermistor 42 and the thermal fuse 43 are arranged such a manner that the thermistor 42 and the thermal fuse 43 contact the heat conduction member 39 from each of the through holes. That is, the thermistor 42 and the thermal fuse 43 are arranged on the heat conduction member 39 to sense heat of the heater 37 via the heat conduction member 39.

The thermistor 42 includes a thermistor element arranged in a casing via ceramic paper or the like for stabilization of a contact state to the heater 37. The thermistor 42 is covered with an insulator such as polyimide tape or the like. In a case where temperature of the heater 37 rises in an abnormal manner, the thermal fuse 43 senses abnormal heat generation of the heater 37 and blocks the electric power to the heater 37. The thermal fuse 43 includes a fuse element inside a metal casing having a tubular shape. The fuse element fuses at a predetermined temperature. In a case where the fuse element fuses due to the abnormal rise in temperature of the heater 37, the thermal fuse 43 blocks a circuit that distributes the electric power to the heater 37. The thermal fuse 43 is arranged in the heat conduction member 39 via thermal conductive grease to prevent an operation failure due to lift of the thermal fuse 43 with respect to the heater 37.

The pressing stay 40 illustrated in FIG. 1 has a substantially U-shaped cross section, and is a long member in the longitudinal direction of the film 36. The pressing stay 40 has a function of enhancing flexural rigidity of the film unit 31. In the present exemplary embodiment, the pressing stay 40 is formed by bending a stainless-steel plate having a thickness of 1.6 mm.

The right and left flanges 41 hold both ends of the pressing stay 40. Each of the flanges 41 includes a vertical groove 41*a*, and each of the right and left side plates 34 includes a vertical groove 34*a*. The vertical grooves 41*a* engage with the respective vertical grooves 34*a*. In the present exemplary embodiment, liquid crystal polymer resin is used as a material of the flange 41.

As illustrated in FIGS. 2A and 2B, a pressing spring 45 is arranged between a pressing unit 41*b* of the flange 41 and a pressing arm 44. The heater 37 is pressed against the pressing roller 32 via the right and left flanges 41, the pressing stay 40, and the support member 38 with the film 36 between the heater 37 and the pressing roller 32. Thus, the heater 37, against elasticity of the pressing roller 32, forms a nip portion N with the pressing roller 32 via the film 36. The nip portion N has a width of approximately 6.2 mm. In the present exemplary embodiment, the film 36 and the pressing roller 32 have a total pressure-contact force of 180 N.

The following is a description pressure distribution of the nip portion in the longitudinal direction in the configuration according to the present exemplary embodiment. A position, of the nip portion, where the maximum pressure is applied is provided in a center portion of a recording medium conveyance region (a center portion of the heat generating resistor 37*b*). A support surface of the support member 38 for supporting one surface of the heater 37 is adjusted by a crown shape form having a center portion that projects from both ends in the longitudinal direction.

When the fixing apparatus 18 performs fixing processing, the drive source (not illustrated) transmits a rotary force to the drive gear G of the pressing roller 32, and the pressing roller 32 is rotationally driven at a predetermined speed in a clockwise direction in FIG. 1. With the rotation of the pressing roller 32, the rotary force acts on the film 36 by a friction force between the pressing roller 32 and the film 36 in the nip portion N. Accordingly, as illustrated in FIG. 1, the film 36 slides in contact with one surface of the heater 37, and is rotated around the outer circumference of the support member 38 in a counterclockwise direction by rotation of the pressing roller 32.

Accordingly, the film 36 is rotated, and electric power is supplied to the heater 37. Then, a recording medium P is introduced in a state where a detection temperature of the thermistor 42 of the heater 37 reaches a target temperature. A fixing inlet guide 30 has a function for guiding the recording medium P bearing an unfixed toner image t toward the nip portion N.

The recording medium P bearing the unfixed toner image t is introduced into the nip portion N. A surface of the recording medium P bearing the toner image t becomes in a close contact to the film 36 in the nip portion N. Then, the recording medium P and the film 36 are pinched and conveyed through the nip portion N. In the course of such conveyance, heat and pressure are applied to the unfixed toner image t on the recording medium P by heat of the film 36 heated by the heater 37 whereby the toner image on the recording medium P is fixed. After passing the nip portion N, the recording medium P is separated from the surface of the film 36 by self-stripping and discharged outside the apparatus by a discharge roller pair (not illustrated). In the present exemplary embodiment, the fixing apparatus 18 has a maximum sheet-passing width of 216 mm.

Further, the fixing apparatus 18 includes a pressure release unit for separating the film unit 31 from the pressing roller 32. The pressure release unit rotates a pressure release cam (not illustrated) to move the flange 41 in a direction away from the pressing roller 32. This separates the film unit 31 from the pressing roller 32 as illustrated FIG. 2A and FIG. 2B. In a case where a paper jam occurs in the fixing apparatus 18, such an operation is performed to facilitate paper jam clearance. In a case where the film 36 is not rotated for a long time, for example, in a sleep mode and a suspend mode, such operation is also performed to prevent image quality degradation due to a compressive deformation mark remaining on the film 36 by the nip portion N. In the present exemplary embodiment, pressure is automatically released by a pressure release motor (not illustrated). However, the pressure release cam may be manually rotated to release pressure.

Characteristics of the Present Exemplary Embodiment

Figure 5A:
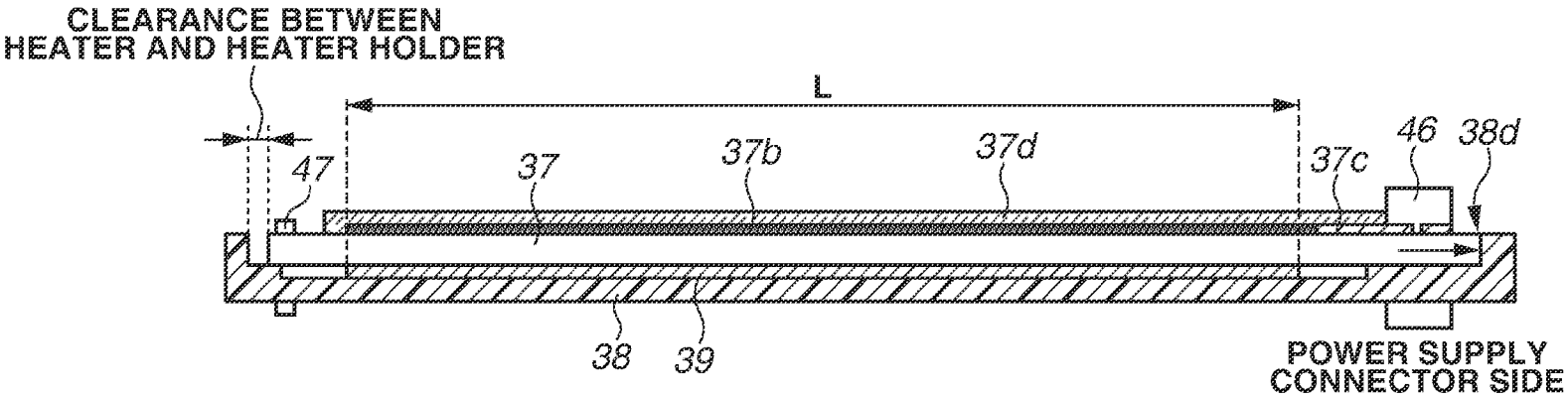
FIG. 5A is a diagram illustrating a support method for the heater and a heat conduction member according to the first exemplary embodiment.
Figure 5B:
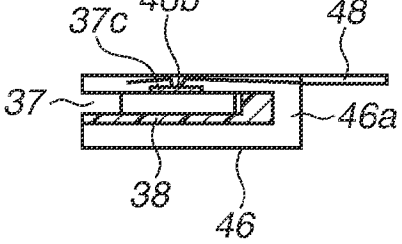
FIG. 5B is a diagram illustrating a connector according to the first exemplary embodiment.
Figure 5C:
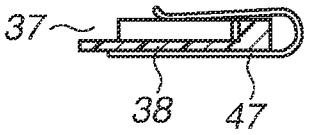
FIG. 5C is a diagram illustrating a heater clip according to the first exemplary embodiment.

Assembly of the heater 37 at the time of manufacture of the fixing apparatus 18 of the present exemplary embodiment is described with reference with FIGS. 5A, 5B, and 5C. As illustrated in FIG. 5A, the heat conduction member 39 is placed on the support member 38, and then the heater 37 is placed on the heat conduction member 39. In the assembly, the heater 37 is arranged in the support member 38 in a state that an end portion of the heater 37 on the side near the connector 46 contacts a contact portion (a positioning portion) 38*d* of the support member 38, the contact portion 38*d* being arranged on the side near the connector 46. A position of the longitudinal direction of the heater 37 being in contact with the contact portion 38*d* is hereinafter referred to as a reference position. The heater 37 is held with respect to the support member 38 by the connector 46. As illustrated in FIG. 5B, the connector 46 includes a U-shaped housing 46*a* made of resin and a contact terminal 46*b*. The connector 46 holds the heater 37 with respect to the support member 38, and causes the contact terminal 46*b* to contact an electrode 37*c* of the heater 37. The contact terminal 46*b* of the connector 46 and the electrode 37*c* of the heater 37 stably contact each other when the heater 37 is in the reference position. However, when the heater 37 is displaced from the reference position, a contact state of the contact terminal 46*b* and the electrode 37*c* may become unstable.

In the present exemplary embodiment, the connector 46 is used as a holding member. However, a function of supplying electric power to the heater 37 and a function of holding the heater 37 may be performed by separate members. The contact terminal 46*b* is connected to a bundle wire 48 that is connect to an alternating current (AC) power source and triac (not illustrated). A heater clip 47 illustrated in FIG. 5C is arranged in an end portion of the heater 37, the end portion being on a side opposite to the other end portion in which the connector 46 is arranged. The heater clip 47 includes a metal plate that is bent in U-shape. The heater clip 47 with a spring property holds the end portion of the heater 37 with the end portion contacting the support member 38. The end portion of the heater 37 pressed against the support member 38 by the heater clip 47 is movable in the longitudinal direction. This prevents the heater 37 from being subject to unnecessary stress that is applied by thermal expansion of the heater 37 or distortion that occurs when pressure is applied and released.

Figures 6A, 6B:
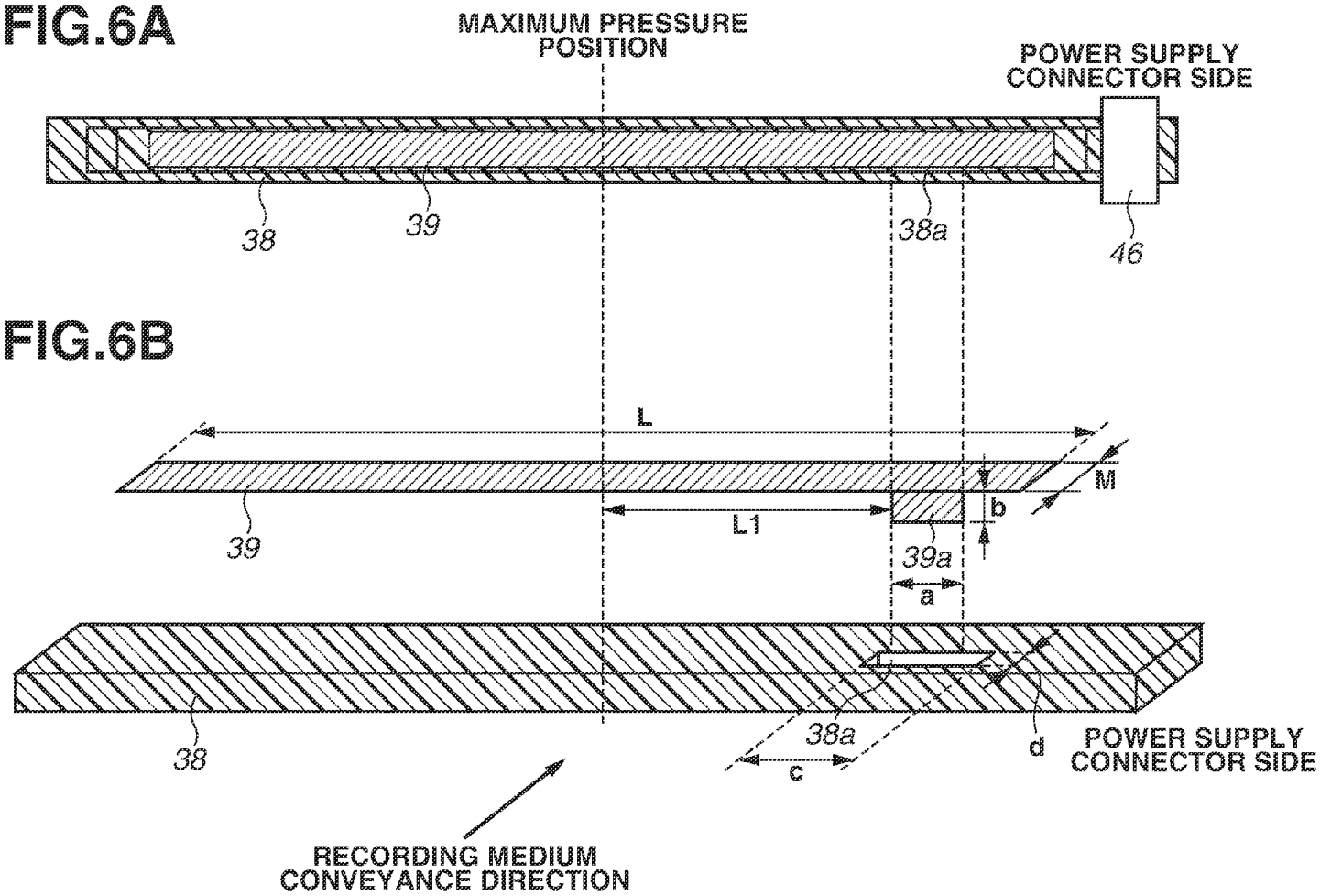
FIG. 6A is a diagram illustrating a support method for the heat conduction member according to the first exemplary embodiment.
FIG. 6B is a diagram illustrating a restriction portion of the heat conduction member according to the first exemplary embodiment.

Next, the heat conduction member 39 of the present exemplary embodiment is described with reference to FIGS. 6A and 6B. FIG. 6A is a diagram illustrating a state in which the heat conduction member 39 is arranged in the support member 38 with the heater 37 being removed. FIG. 6B is a perspective view illustrating a restriction portion of the heat conduction member 39 with respect to the support member 38. The support member 38 and the restriction portion of the heat conduction member 39 which are characterizing portions of the present exemplary embodiment are described with reference to FIG. 6B. In the present exemplary embodiment, an aluminum plate (a plate member) having a uniform thickness of 0.3 mm is used as the heat conduction member 39. In the aluminum plate serving as the heat conduction member 39, a portion that contacts the heater 37 has a length L of 222 mm in the longitudinal direction and a width M of 5 mm in the transverse direction. As illustrated in FIG. 6B, the heat conduction member 39 includes a bent portion 39*a* serving as a restriction portion. The bent portion 39*a* is provided in a location that is L1=80 mm away from the center portion of the heat conduction member 39 in the longitudinal direction to the side on which the connector 46 is arranged. The bent portion 39*a* is formed by bending an end portion of the transverse direction of the heat conduction member 39 in a direction approaching the support member 38. The bent portion 39*a* is formed in a size having a length of a=8 mm in the longitudinal direction and a depth of b=3 mm. The bent portion 39*a* is inserted into a hole 38*a* provided in the support member 38 such that the heat conduction member 39 does not move in the longitudinal direction with respect to the support member 38.

The hole 38*a* is slightly bigger for the bent portion 39*a*. In the present exemplary embodiment, the hole 38*a* has c=8.5 mm and d=4 mm, and a gap generated in the longitudinal direction of the heat conduction member 39 has a length of c−a=0.5 mm. As illustrated in FIG. 5A, the heat conduction member 39 is arranged to contact the heater 37 across the longitudinal direction. In the present exemplary embodiment, a length of the heat conduction member 39 is substantially the same as that of the heat generating resistor 37*b*. Further, left and right ends of the heat conduction member 39 are arranged in substantially the same positions as those of the heat generating resistor 37*b*.

Effects of the Present Exemplary Embodiment

Figure 7A:
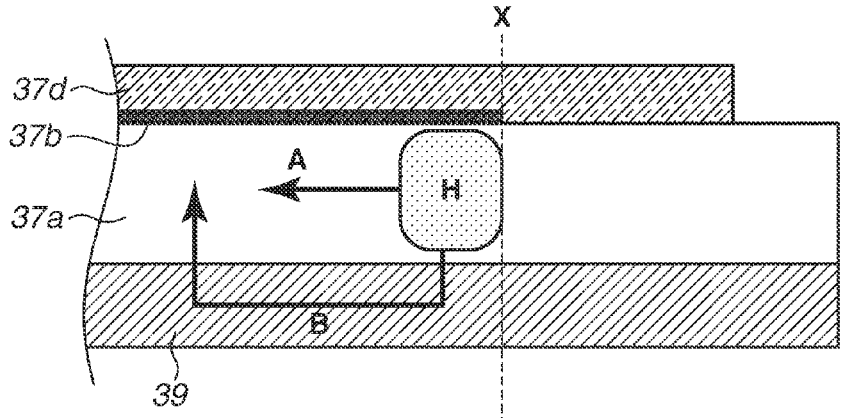
FIG. 7A is an enlarged partial view of the heater and the heat conduction member with a flow of heat in the fixing apparatus according to the first exemplary embodiment.
Figure 7B:
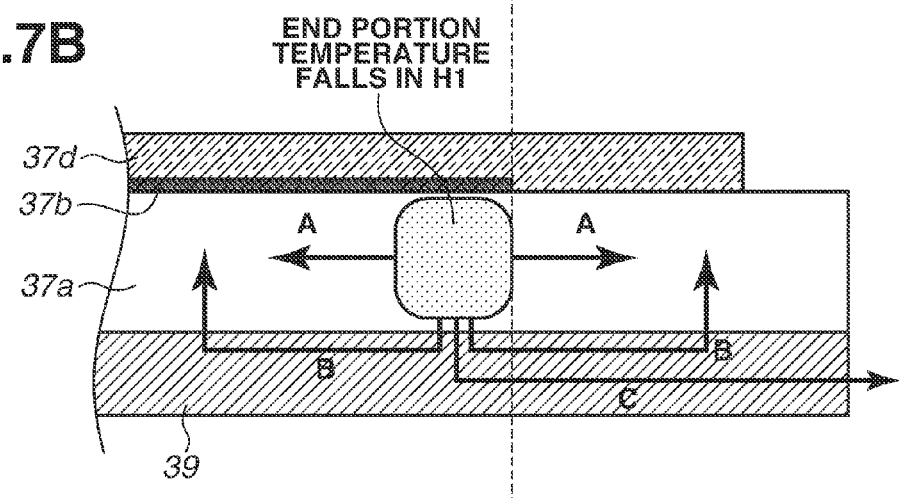
FIG. 7B is a diagram illustrating a flow of heat in a configuration in which the heat conduction member is longer than a heat generating resistor.
Figure 7C:
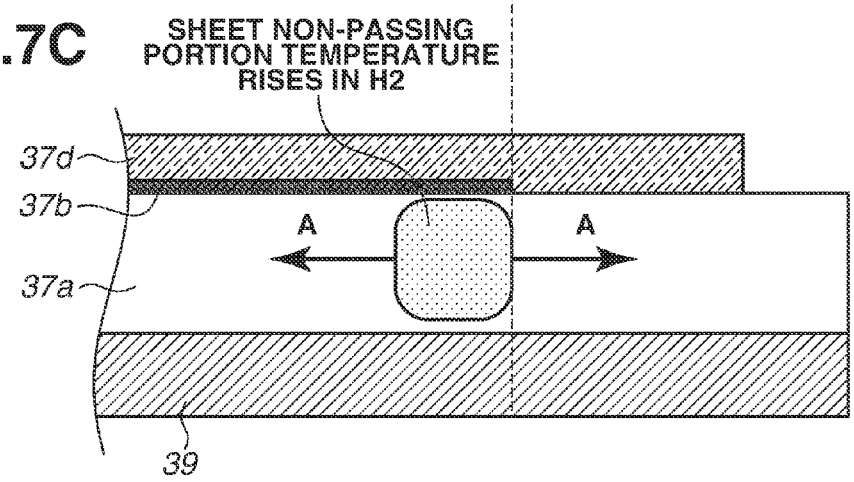
FIG. 7C is a diagram illustrating a flow of heat in a configuration in which the heat conduction member is shorter than the heat generating resistor.

FIGS. 7A, 7B, and 7C are enlarged sectional views illustrating the heater 37 and the heat conduction member 39 in the longitudinal direction. With FIGS. 7A, 7B, and 7C, a description is given of a mechanism for uniform heat distribution of the heater 37 in a direction perpendicular to the recording medium conveyance direction in a case where temperature in a sheet non-passing portion rises by successive fixing processing performed on a plurality of small recording media. Each of FIGS. 7A, 7B, and 7C illustrates a positional relation between the right end portions of the heat generating resistor 37*b* of the heater 37 and the heat conduction member 39 in the longitudinal direction.

In the present exemplary embodiment, alumina used as the substrate 37*a* has a heat conductivity of approximately 26 W/mK, whereas aluminum used as the heat conduction member 39 has a heat conductivity of approximately 230 W/mK. In a case where the heat conduction member 39 has a higher heat conductivity than the substrate 37*a*, heat distribution of the heater 37 can be uniform more easily. In addition to the aluminum as a material of the heat conduction member 39, copper and graphite sheet may be used. In the longitudinal direction, in the present exemplary embodiment as illustrated in FIG. 7A, a width of the heat generating resistor 37*b* and a width of the heat conduction member 39 are substantially the same. Further, as illustrated in FIG. 7A, a position of one end portion of the heat generating resistor 37*b* matches a position of one end portion of the heat conduction member 39 (see a broken line X). Therefore, when fixing processing is performed on a large recording medium, the fixing apparatus 18 according to the present exemplary embodiment can prevent a fixing failure from occurring in an end portion of the recording medium, and when fixing processing is performed on a small recording medium, the fixing apparatus 18 according to the present exemplary embodiment can suppress a rise of temperature in a sheet non-passing portion.

Hereinafter, reasons for such effects are described. In FIG. 7A, assume that temperature in a portion H of the substrate 37*a* in the longitudinal direction becomes higher than that in other portions. In addition to a heat flow A in the longitudinal direction inside the substrate 37*a*, a heat flow from the substrate 37*a* to the heat conduction member 39 is generated in a portion of the substrate 37*a*, the portion being in contact with the heat conduction member 39. In addition, a heat flow B in which heat flows in the longitudinal direction within the heat conduction member 39 and returns to the substrate 37*a* again is generated. Such heat flows create uniform heat distribution of the heater 37.

FIG. 7B is an enlarged view illustrating a state in which one end portion of the heat conduction member 39 extending outward in the longitudinal direction is longer than an end portion of the heat generating resistor 37*b*. In such a case, in addition to heat flows A and B, heat is released by heat dissipation C from the end portion of the heat conduction member 39. As a result, temperature falls excessively in a portion H1 of the heater 37. This may cause a fixing failure in an area corresponding to the portion H1 when fixing processing is performed on a large recording medium. FIG. 7C is an enlarged view illustrating a state in which the heat generating resistor 37*b* extending outward in the longitudinal direction is longer than an end portion of the heat conduction member 39. In such a case, the suppression effect to a rise of temperature in a sheet non-passing portion cannot be achieved in a portion H2 in which heat of the heat generating resistor 37*b* does not flow to the heat conduction member 39.

Therefore, when fixing processing is performed on a large recording medium, the fixing apparatus 18 according to the present exemplary embodiment can prevent a fixing failure from occurring in an end portion of the large recording medium, and when fixing processing is performed on a small recording medium, the fixing apparatus 18 according to the present exemplary embodiment can suppress a rise of temperature in a sheet non-passing portion.

The effects realized by the configuration according to the present exemplary embodiment are described with reference to FIGS. 8A, 8B, 8C, and 8D. In such a case, a deformation amount ΔL (mm) of the heat conduction member 39 in a longitudinal direction when the heater 37 generates heat can be calculated by the following equation:

$$\Delta L = L \times \alpha \times \Delta T,$$

where L is a length, α is a linear expansion coefficient, and ΔT is a temperature difference.

The length L in the longitudinal direction is 222 mm, the linear expansion coefficient of aluminum is α=2.3×10^-5/° C., and a temperature of the substrate at fixing processing is approximately 200° C. Hence, ΔT=180° C., where a normal temperature is 20° C. If these values are substituted into the above equation, 222×2.3×10^-5×180=0.92 mm. That is, the aluminum plate elongates in the longitudinal direction by 0.92 mm when fixing processing is performed. On the other hand, liquid crystal polymer used for the support member 38 is Sumika Super LCP E5204L manufactured by Sumitomo Chemical Co., Ltd., and a linear expansion coefficient thereof is 1.3×10^-5/° C. Hence, the support member 38 elongates in the longitudinal direction by only 222×1.3×10^-5×180=0.52 mm. Since alumina used for the substrate 37*a* of the heater 37 has a linear expansion coefficient of 0.75×10^-5/° C., the substrate 37*a* elongates in the longitudinal direction by only 222×0.75×10^-5×180=0.3 mm.

Therefore, when temperature of the heater 37 illustrated in FIG. 8A rises from a normal temperature (20° C.) to a fixing processing temperature (200° C.), the heat conduction member 39 elongates, as illustrated in FIG. 8B, to the right and left around a maximum pressure position in the nip portion of the heater 37 by thermal expansion. Since the heat conduction member 39 and the support member 38 tightly adhere to each other in the maximum pressure position compared to other positions, the heat conduction member 39 and the support member 38 do not tend to be displaced. Consequently, it is conceivable that such thermal expansion occurs. As described above, since the linear expansion coefficient of the heat conduction member 39 is higher than that of the support member 38, the bent portion 39*a* of the heat conduction member 39 contacts a side surface of the hole 38*a* of the support member 38 in an area D illustrated in FIG. 8B. This restricts elongation of the heat conduction member 39. Although the elongation in the longitudinal direction is restricted, the heat conduction member 39 is to further elongate. This causes deformation in order that the elongation is absorbed. The deformed portion applies a force F to the heater 37. The force F is applied in a direction (toward the upper right in FIG. 8B) indicated by a dotted line shown in FIG. 8B. A reason for generating the force F is described with reference to FIGS. 8C and 8D that are enlarged views of the area D illustrated in FIG. 8B. Since the bent portion 39*a* of the heat conduction member 39 further elongates as illustrated in FIG. 8C even when contacting the side surface of the hole 38*a* of the support member 38, the heat conduction member 39 is deformed so as to rotate clockwise around an area G as illustrated in FIG. 8D. The deformed portion of the heat conduction member 39 applies the force F to the heater 37. The force F can be divided into a force Fh toward the connector side, and a vertical drag force N with respect to a pressure Fp received from the support member 38. The force Fh toward the connector side is expressed by the following equation below:

$$Fh = \mu \times F_N = \mu \times F_p(N),$$

where μ is a static friction coefficient between the heat conduction member 39 and the heater 37, and $F_N$ (N) is a vertical drag force.

In the present exemplary embodiment, since the force Fh serves as a force in a direction in which the heater 37 contacts the contact portion 38*d* of the support member 38, the heater 37 does not move from the reference position even if the force Fh is generated by thermal expansion of the heat conduction member 39. The bent portion 39*a* of the heat conduction member 39 may be arranged in a region away from the connector 46 than the maximum pressure position of the nip portion. In such a case, the bent portion 39*a* deforms when the heat conduction member 39 is thermally expanded. However, the deformation of the bent portion 39*a* is symmetrical with respect to the maximum pressure position. Thus, a direction of the force applied to the heater 37 by the deformed portion of the heat conduction member 39 is opposite to that of the above described present exemplary embodiment, and the force is applied in a direction in which the heater 37 is away from the contact portion 38*d* by thermal expansion of the heat conduction member 39. This causes the heater 37 to be displaced more easily from the reference position. The displacement of the heater 37 from the reference position causes displacement of a region to be heated in the film. This may degrade toner image fixability.

Accordingly, in the longitudinal direction, the bent portion 39*a* needs to be arranged only in a region closer to the connector 46 than the maximum pressure position of the nip portion within the heat conduction member 39 to realize the effects by the present exemplary embodiment.

According to the present exemplary embodiment, therefore, the heater 37 is not displaced from the reference position even if the heat conduction member 39 being in contact with the heater 37 is thermally expanded. This can prevent an image from being affected. In addition to such an effect, an electrical connection between the heater 37 and the connector 46 can be stably maintained.

In the present exemplary embodiment, the maximum pressure position of the nip portion is provided in the center portion of the recording medium conveyance region. However, the configuration is not limited thereto. The effects by the present exemplary embodiment can be realized as long as the bent portion 39*a* of the heat conduction member 39 is arranged only in a region closer to the connector 46 than the maximum pressure position of the nip portion within the heat conduction member 39 in the longitudinal direction.

Although elongation of each of the heater 37 and the support member 38 is omitted in FIG. 8B, the heater 37 and the support member 38 elongate in a strict sense. In FIG. 8D, the deformation amount of the heat conduction member 39 is exaggerated for the sake of clarity.

In the present exemplary embodiment, a position of the end portion of the heat conduction member 39 and a position of the end portion of the heat generating resistor 37*b* match each other in a longitudinal direction, but are not limited to such a configuration.

A fixing apparatus according to a second exemplary embodiment is similar to that of the first exemplary embodiment except for two bent portions that serve as restriction portions for restricting a longitudinal movement of a heat conduction member 39. Components similar to the first exemplary embodiment will be given the same reference numerals as above, and description thereof will be omitted.

Figures 9A, 9B:
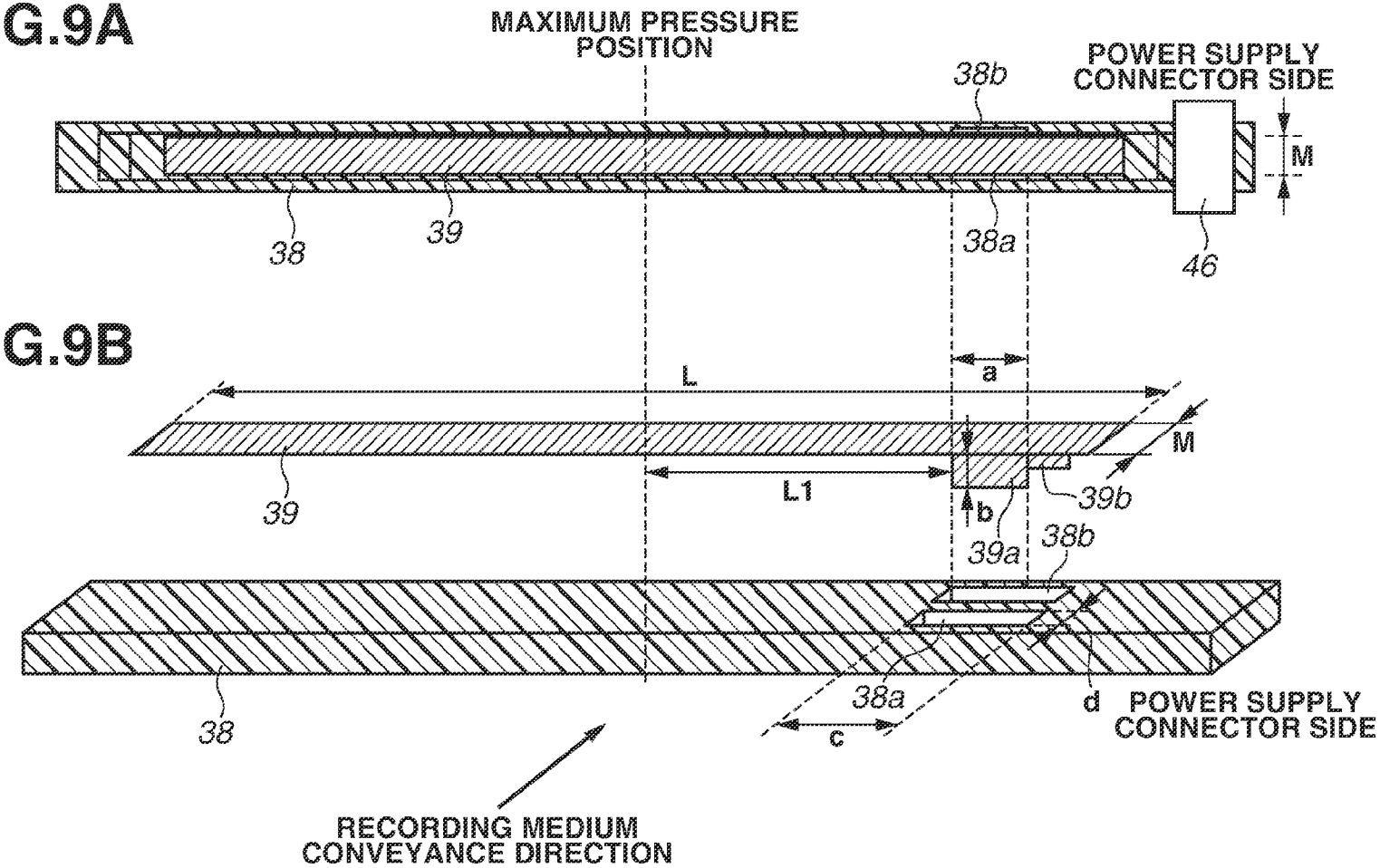
FIG. 9A is a diagram illustrating a support method for a heat conduction member according to a second exemplary embodiment of the present invention.
FIG. 9B is a perspective view illustrating a restriction portion of the heat conduction member according to the second exemplary embodiment.

FIGS. 9A and 9B are diagrams illustrating the heat conduction member 39 according to the present exemplary embodiment. FIG. 9A illustrates a state in which the heat conduction member 39 is arranged in a support member 38 with a heater 37 removed. FIG. 9B is a perspective view illustrating a restriction portion of the heat conduction member 39 with respect to the support member 38. The support member 38 and the restriction portion of the heat conduction member 39 which are characterizing portions of the present exemplary embodiment are described with reference to FIG. 9B. In the present exemplary embodiment, an aluminum plate having a uniform thickness of 0.3 mm is used as the heat conduction member 39. In the heat conduction member 39, a portion that contacts the heater 37 has a length L of 222 mm in the longitudinal direction and a width M of 5 mm in the transverse direction. The heat conduction member 39, as illustrated in FIG. 9B, includes a bent portion 39*a* having a size that is substantially the same as that of the first exemplary embodiment. The bent portion 39*a* is provided in a location on an upstream side in the recording medium conveyance direction. The location is L1=80 mm away from a center portion of the heat conduction member 39 in the longitudinal direction toward the side on which the connector 46 is arranged. In the second exemplary embodiment, in addition to such a bent portion 39*a*, a bent portion 39*b* is arranged on a downstream side in the recording medium conveyance direction. Size of the bent portion 39*b* is substantially the same as that of the bent portion 39*a*. These two bent portions 39*a* and 39*b* are inserted into respective holes 38*a* and 38*b* of the support member 38. Size of each of the holes 38*a* and 38*b* of the second exemplary embodiment is substantially the same as that of the hole 38*a* of the first exemplary embodiment.

Figure 10A:
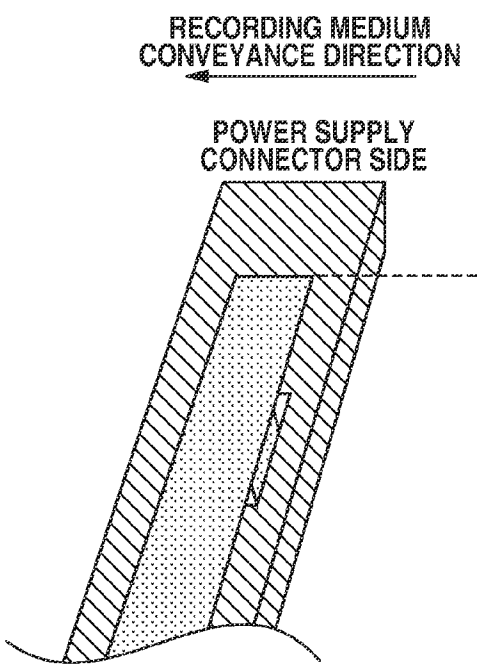
FIG. 10A is a perspective view illustrating the heat conduction member when the heater is at normal temperature according to the first exemplary embodiment.
Figure 10B:
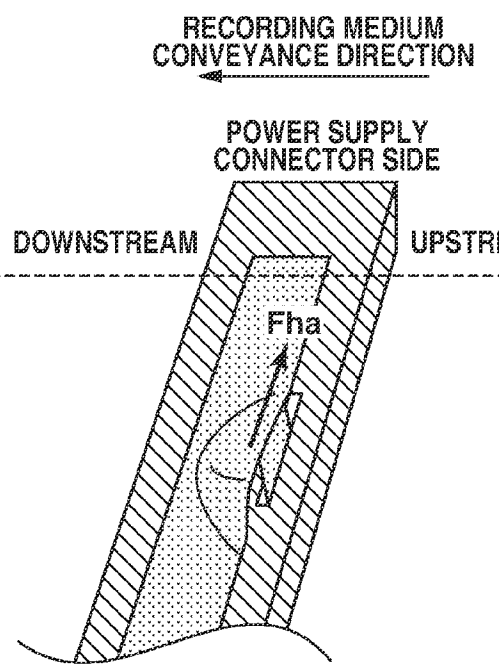
FIG. 10B is a perspective view illustrating the heat conduction member when the heater generates heat according to the first exemplary embodiment.
Figure 10C:
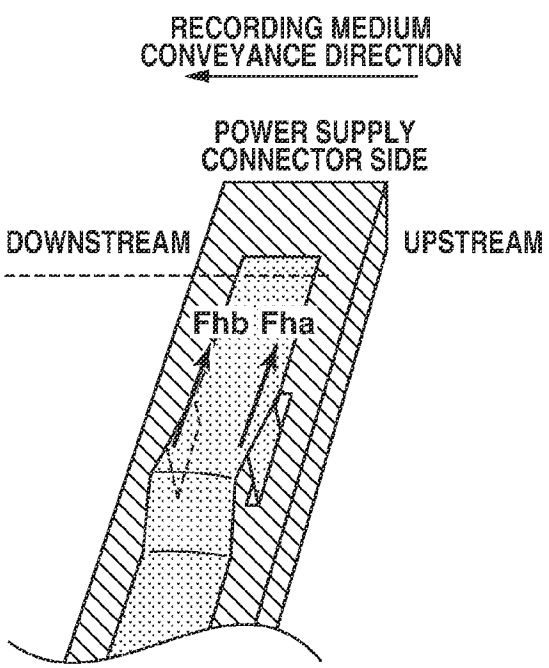
FIG. 10C is a perspective view illustrating the heat conduction member when the heater generates heat according to the second exemplary embodiment.

Differences between the first exemplary embodiment and the present exemplary embodiment are described with reference to FIGS. 10A, 10B, and 10C illustrating a state in which the heater 37 is not present. FIG. 10A is a diagram illustrating a state of the heat conduction member 39 when the heater 37 is at normal temperature in a configuration according to the first exemplary embodiment. FIG. 10B is a diagram illustrating a state of the heat conduction member 39 when the heater 37 generates heat in the configuration according to the first exemplary embodiment. FIG. 10C is a diagram illustrating a state of the heat conduction member 39 when the heater 37 generates heat in a configuration according to the present exemplary embodiment. When the heater 37 generates heat in the state illustrated in FIG. 10A, the heat conduction member 39 elongates. This allows the bent portion 39*a* serving as a restriction portion to contact a side surface of the hole 38*a* of the support member 38, so that the elongation of the heat conduction member 39 is restricted. The heat conduction member 39 is to further elongate although a movement in the longitudinal direction is restricted. Assume that the heater 37 is absent, in the first exemplary embodiment, a portion including the bent portion 39*a* of the heat conduction member 39 is lifted and deformed on an upstream side in the recording medium conveyance direction as illustrated in FIG. 10B. As described in the first exemplary embodiment, a force Fha in a direction indicated by an arrow shown in FIG. 10B is generated to the heater 37.

In the configuration according to the present exemplary embodiment, on the other hand, the bent portion 39*b* is also arranged on the downstream side in the recording medium conveyance direction. Accordingly, when the heater 37 generates heat, the heat conduction member 39 elongates. This allows the bent portion 39*a* and the bent portion 39*b* to contact the respective holes 38*a* and 38*b* of the support member 38, so that the elongation of the heat conduction member 39 is restricted. Since the heat conduction member 39 is to further elongate although a movement in the longitudinal direction is restricted, the heat conduction member 39 is deformed as illustrated in FIG. 10C. In addition to the force Fha in a direction indicated by an arrow shown in FIG. 10C, a force Fhb is generated. In the first exemplary embodiment, a region in which the deformed portion of the heat conduction member 39 contacts the heater 37 is larger on the upstream side than the downstream side in the recording medium conveyance direction, the upstream side being on which the bent portion 39*a* is present. In such a region, stress tends to be concentrated in the heater 37. In the present exemplary embodiment, on the other hand, a region in which the deformed portion of the heat conduction member 39 contacts the heater 37 is enlarged to a downstream side in the recording medium conveyance direction. Therefore, stress concentration in the heater 37 can be relieved compared to the first exemplary embodiment.

In the present exemplary embodiment, similar to the first exemplary embodiment, the heater 37 is not displaced from the reference position even if the heat conduction member 39 being in contact with the heater 37 is thermally expanded. This can not only prevent an image from being affected due to displacement of the heater 37, but also stably maintain an electrical connection between the heater 37 and the connector 46. In addition to such effects, the stress concentration in the heater 37 by the heat conduction member 39 can be relieved.

Figures 11A, 11B:
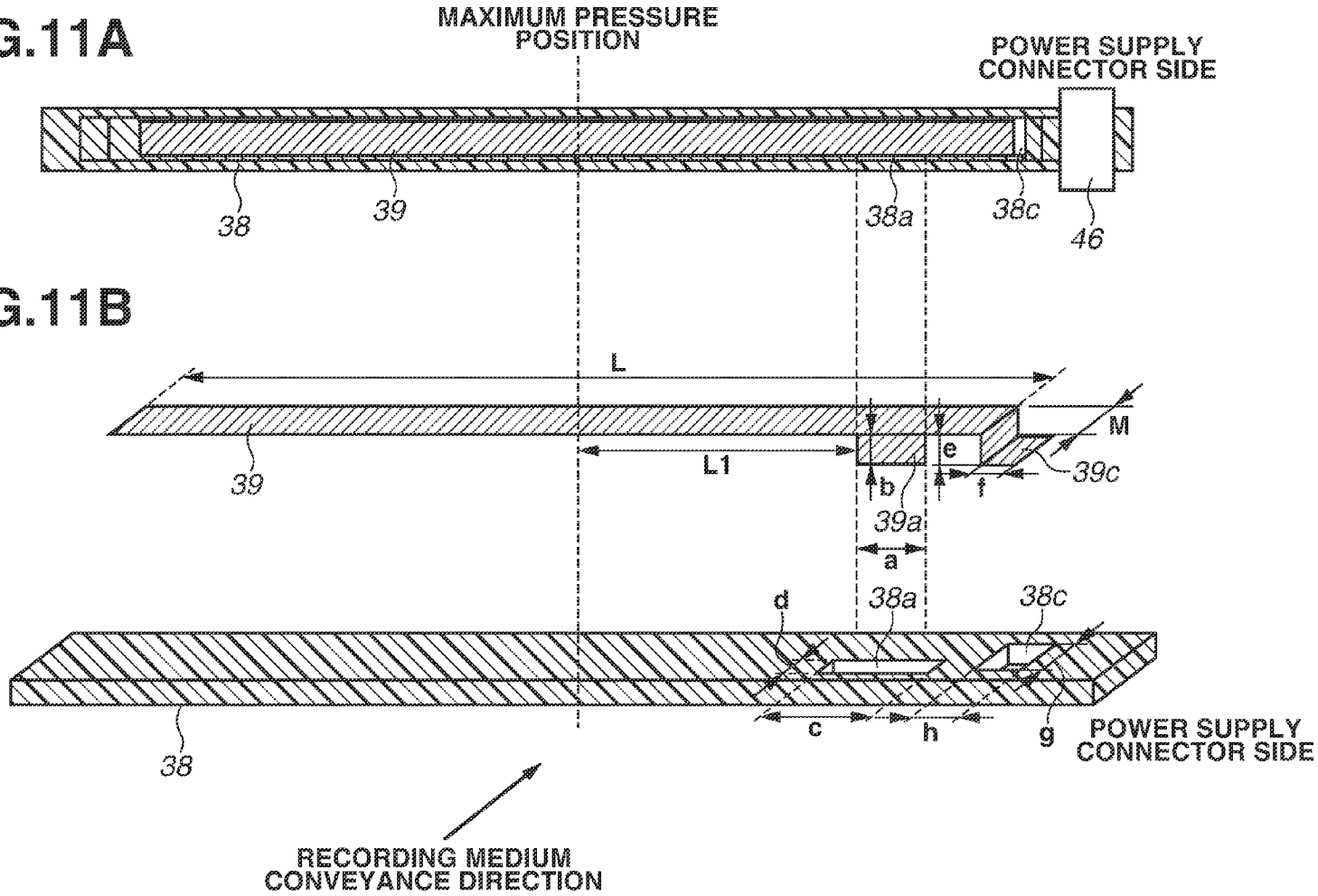
FIG. 11A is a diagram illustrating a support method for a heat conduction member according to a third exemplary embodiment of the present invention.
FIG. 11B is a perspective view illustrating a restriction portion of the heat conduction member according to the third exemplary embodiment.

A third exemplary embodiment is described using an example case in which a restriction portion for restricting a movement of a heat conduction member 39 in a thickness direction of a heater 37 is arranged in addition to a restriction portion for restricting a longitudinal movement of the heat conduction member 39. As for a fixing apparatus of the present exemplary embodiment, components similar to the first exemplary embodiment will be given the same reference numerals as above, and description thereof will be omitted. FIGS. 11A and 11B are diagrams illustrating a heat conduction member 39 according to the present exemplary embodiment. FIG. 11A is a diagram illustrating a state in which the heat conduction member 39 is arranged in a support member 38 with the heater 37 removed. FIG. 11B is a perspective view illustrating a restriction portion of the heat conduction member 39 with respect to the support member 38.

With FIG. 11B, the support member 38 and the restriction portion of the heat conduction member 39 that are characterizing portions of the present exemplary embodiment are described. In the present exemplary embodiment, an aluminum plate having a uniform thickness of 0.3 mm is used as the heat conduction member 39. In the heat conduction member 39, a portion that contacts the heater 37 has a length L of 222 mm in the longitudinal direction and a width M of 5 mm in the transverse direction. The heat conduction member 39, as illustrated in FIG. 11B, includes a bent portion 39*a* having a size that is substantially the same as that of the first exemplary embodiment. The bent portion 39*a* is provided in a location that is L1=80 mm away from a center portion of the heat conduction member 39 in the longitudinal direction toward the side on which a connector 46 is arranged. The heat conduction member 39 further includes a bent portion 39*c* that is bent in L-shape having a depth e=3.5 mm and a length f=2 mm in one end portion in which the connector 46 is arranged, out of both end portions in the longitudinal direction. These two bent portions 39*a* and 39*c* are inserted into respective holes 38*a* and 38*c* of the support member 38. The holes 38*a* and 38*c* are slightly bigger for the respective bent portions 39*a* and 39*c*. In the present exemplary embodiment, c=8.5 mm, d=0.4 mm, g=5.1 mm, and h=3.0 mm. The hole 38*a* has a play (0.5 mm) in the longitudinal direction with respect to the bent portion 39*a*, whereas the hole 38*c* has a play (1 mm) in the longitudinal direction with respect to the bent portion 39*c*. The play in the longitudinal direction of the hole 38*a* is smaller than that of the hole 38*c*. A reason for such a difference is described below.

Figures 12A, 12B:
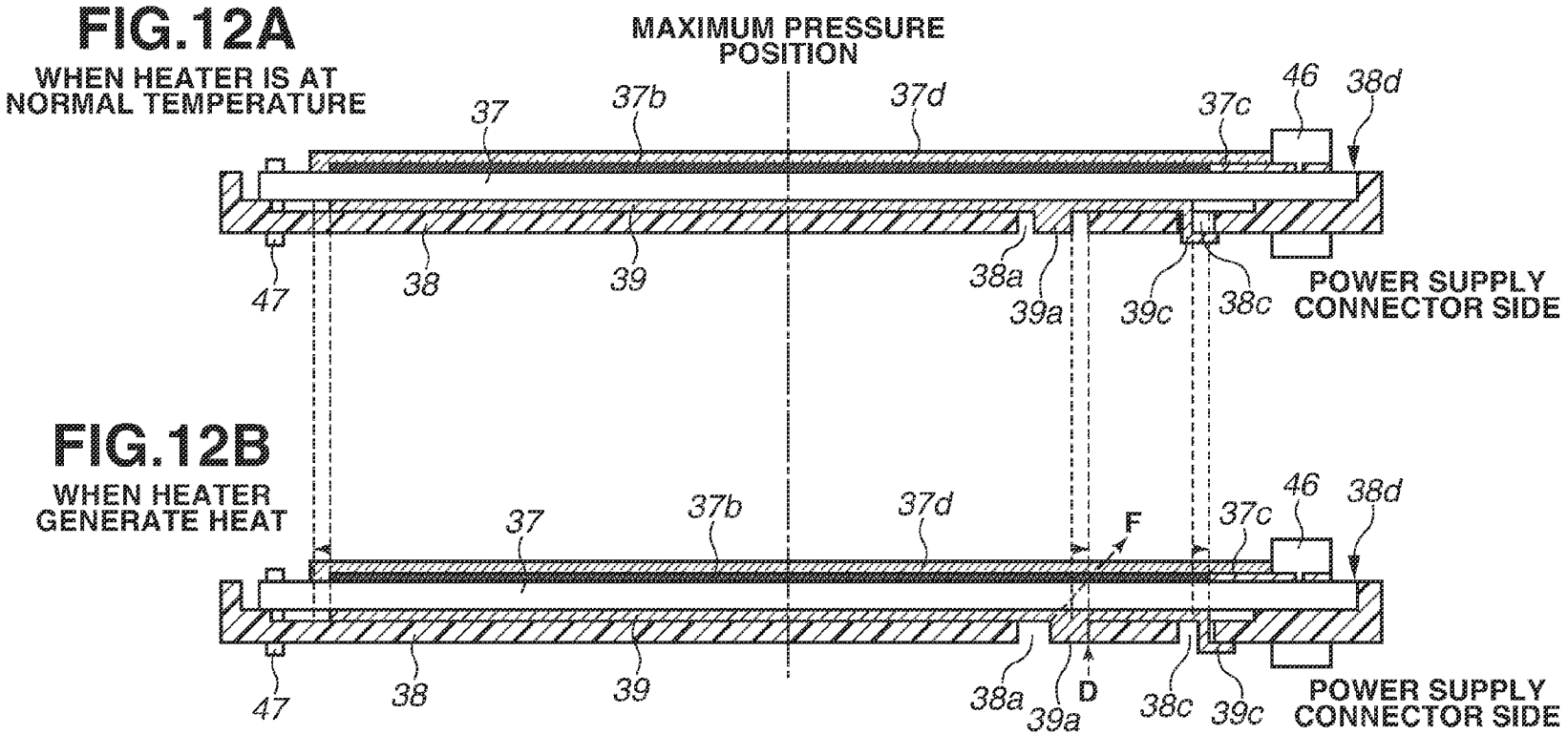
FIG. 12A is a diagram illustrating a state of the heat conduction member when a heater is at normal temperature according to the third exemplary embodiment.
FIG. 12B is a diagram illustrating a state of the heat conduction member when the heater generates heat according to the third exemplary embodiment.

FIG. 12A is a cross-sectional view in the longitudinal direction illustrating a state in which the heat conduction member 39 and the support member 38 are assembled together. In FIG. 12A, the heater 37 is at a normal temperature (20° C.). FIG. 12B is a diagram illustrating a state in which the heater 37 generates heat.

In the configuration according to the first exemplary embodiment, a movement of the heat conduction member 39 is not restricted with respect to a thickness direction of the heater 37. In this case, after the heat conduction member 39 is attached, there is a possibility that the heat conduction member 39 may be detached toward the thickness direction of the heater 37. In the present exemplary embodiment, the bent portion 39*c* of the heat conduction member 39 is arranged to solve such an issue, and the bent portion 39*c* can prevent the heat conduction member 39 from coming off the support member 38 the thickness direction of the heater 37. However, when the heater 37 generates heat, the heat conduction member 39 may elongate with thermal expansion. In such a case, if the bent portion 39*c* of the present exemplary embodiment first contacts the hole 38*c* of the support member 38, the bent portion 39*a* cannot function as a restriction portion in the longitudinal direction of the heat conduction member 39. Therefore, a play in the longitudinal direction of the hole 38*c* with respect to the bent portion 39*c* is greater than that of the hole 38*a* with respect to the bent portion 39*a*.

When the heater 37 generates heat in a state illustrated in FIG. 12A, the heat conduction member 39 elongates and the bent portion 39*a* first contacts the hole 38*a* of the support member 38 as illustrated in FIG. 12B. This restricts a movement of the heat conduction member 39. Since there is the play, the bent portion 39*c* and a side surface of the hole 38*c* do not contact each other.

According to the present exemplary embodiment, similar to the first exemplary embodiment, the heater 37 is not displaced from the reference position even if the heat conduction member 39 being in contact with the heater 37 is thermally expanded. This can not only prevent an image from being affected due to displacement of the heater 37, but also stably maintain an electrical connection between the heater 37 and the connector 46. In addition to such effects, the heat conduction member 39 is prevented from coming off toward the thickness direction with respect of the support member 38.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-250404, filed Dec. 10, 2014, which is hereby incorporated by reference herein in its entirety.

What is claimed is:

1. A fixing apparatus that fixes a toner image on a recording medium, the fixing apparatus comprising:

a film having a tubular shape;

a heater having a long narrow shape and contacting an inner surface of the film;

a heat conduction member that contacts, along a longitudinal direction of the heater, a surface on an opposite side of a surface of the heater contacting the film;

a support member configured to support the heater via the heat conduction member;

a roller that forms a pressure contact portion with the heater via the film; and a connector arranged in any one of end portions of the heater in the longitudinal direction and configured to supply electric power to the heater, wherein the toner image formed on the recording medium is heated by heat from the film and is fixed on the recording medium, wherein the pressure contact portion is configured so that a maximum pressure position thereof is in a center portion thereof in the longitudinal direction, wherein the heat conduction member includes a restriction portion configured to restrict a movement of the heat conduction member in the longitudinal direction of the heater with respect to the support member, and wherein the restriction portion is arranged in a region, of the heat conduction member, between the maximum pressure position of the pressure contact portion and an end portion of the heat conduction member which is at the same side of the connector in the longitudinal direction, and the restriction portion is not arranged in a region, of the heat conduction member, between the maximum pressure position of the pressure contact portion and an end portion of the heat conduction member which is at an opposite side of the connector in the longitudinal direction.

2. The fixing apparatus according to claim 1, wherein the heater includes a substrate and a heat generating resistor formed on the substrate, and wherein the heat conduction member has a higher heat conductivity than the substrate.

3. The fixing apparatus according to claim 1, wherein the support member includes a positioning portion that contacts an end portion, at the same side of the connector in the longitudinal direction, of the heater.

4. The fixing apparatus according to claim 1, wherein the heat conduction member is formed of a plate material.

5. The fixing apparatus according to claim 1, wherein the restriction portion is a bent portion formed by bending a part of the heat conduction member in a direction approaching the support member, and wherein the movement of the heat conduction member in the longitudinal direction with respect to the support member is restricted by the bent portion being attached to the support member.

6. The fixing apparatus according to claim 1, wherein the pressure contact portion is a nip portion for conveying a recording material.

7. The fixing apparatus according to claim 1, wherein the support member includes a hole into which the restriction portion of the heat conduction member is inserted.

8. A fixing apparatus that fixes a toner image on a recording medium, the fixing apparatus comprising:

a film having a tubular shape;

a heater having a long narrow shape and contacting an inner surface of the film;

a heat conduction member that contact, along a longitudinal direction of the heater, a surface on an opposite side of a surface of the heater contacting the film;

a support member configured to support the heater via the heat conduction member, the support member including a positioning portion configured to position the heater with respect to the support member in the longitudinal direction by contacting an end portion of the heater in the longitudinal direction; and a roller that forms a pressure contact portion with the heater via the film, wherein the toner image formed on the recording medium is heated by heat from the film and is fixed on the recording medium, wherein the pressure contact portion is configured so that a maximum pressure position thereof is in a center portion thereof in the longitudinal direction, wherein the heat conduction member includes a restriction portion configured to restrict a movement of the heat conduction member in the longitudinal direction of the heater with respect to the support member, and wherein the restriction portion is arranged in a region, between the maximum pressure position of the pressure contact portion and an end portion of the heat conduction member which is at the same side of the positioning portion of the support member in the longitudinal direction, and the restriction portion is not arranged in a region, of the heat conduction member, between the maximum pressure position of the pressure contact portion and an end portion of the heat conduction member which is at an opposite side of the positioning portion of the support member in the longitudinal direction.

9. The fixing apparatus according to claim 8, wherein the heater includes a substrate and a heat generating resistor formed on the substrate, and wherein the heat conduction member has a higher heat conductivity than the substrate.

10. The fixing apparatus according to claim 8, wherein the heat conduction member is formed of a plate material.

11. The fixing apparatus according to claim 8, wherein the pressure contact portion is a nip portion for conveying a recording material.

12. The fixing apparatus according to claim 8, wherein the support member includes a hole into which the restriction portion of the heat conduction member is inserted.

* * * * *